US005911597A

United States Patent [19]

Oshitani

[11] Patent Number: 5,911,597

[45] Date of Patent: Jun. 15, 1999

[54] CONNECTOR FOR FLEXIBLE CONDUCTIVE LINE COMPONENTS

[75] Inventor: Akiyoshi Oshitani, Sayama, Japan

[73] Assignee: Ace-Five Co., Ltd., Sayama, Japan

[21] Appl. No.: 09/013,476

[22] Filed: Jan. 26, 1998

[51] Int. Cl.[6] ..... H01R 9/67

[52] U.S. Cl. ..... 439/495

[58] Field of Search ..... 439/495, 67, 77, 439/260

[56] References Cited

U.S. PATENT DOCUMENTS

| | | | |
|---|---|---|---|
| 5,519,578 | 5/1996 | Fujii | 439/67 |
| 5,549,485 | 8/1996 | Chishima et al. | 439/495 |
| 5,800,204 | 9/1998 | Niitsu | 439/495 |

*Primary Examiner*—Gary Paumen
*Assistant Examiner*—Briggitte R. Hammond
*Attorney, Agent, or Firm*—Chi Ping Chang

[57] ABSTRACT

The present invention relates to a connector for flexible conductive line components suitable for a lower mounted profile in a device mounted on a printed circuit board. The connector comprises a metal plate, resilient spring portions, and connection terminal portions wherein the resilient portions, which allow the metal plate and individual contacts to accommodate and clamp a inserted flexible printed circuit parallel with respect to the printed circuit board, are disposed such that the lengthwise spring extension thereof lies in the parallel direction, leaving the height unaffected. The metal plate further comprises a substantially U-shaped transverse cross section which affords both a low mounting profile and a stable connection that experiences minimal bending.

3 Claims, 6 Drawing Sheets

FIGURE 8 - PRIOR ART
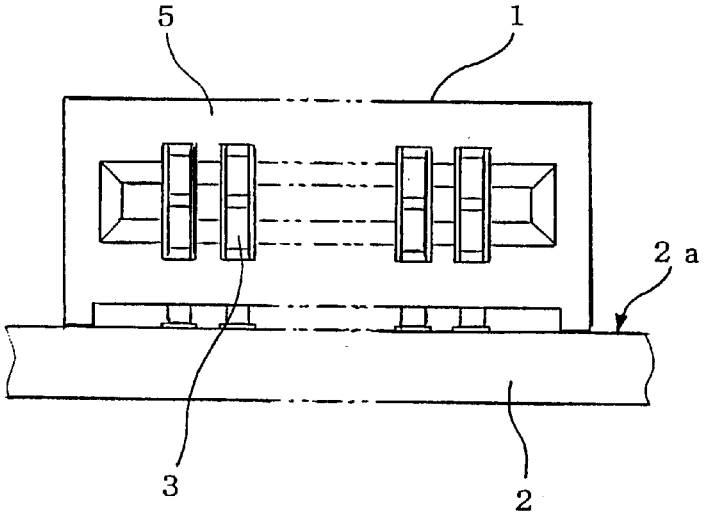
FIGURE 9 - PRIOR ART
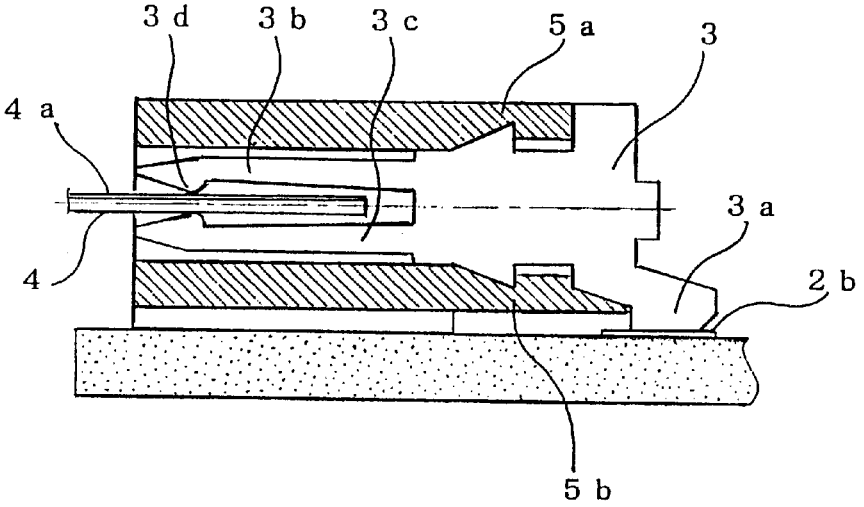

FIGURE 10 - PRIOR ART
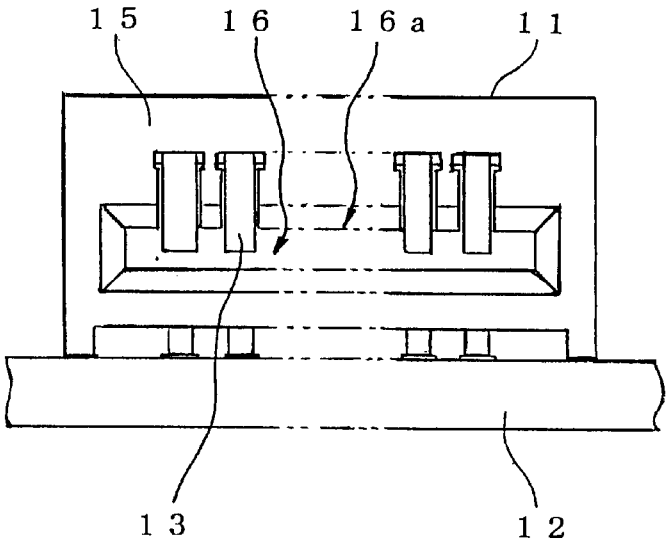
FIGURE 11 - PRIOR ART
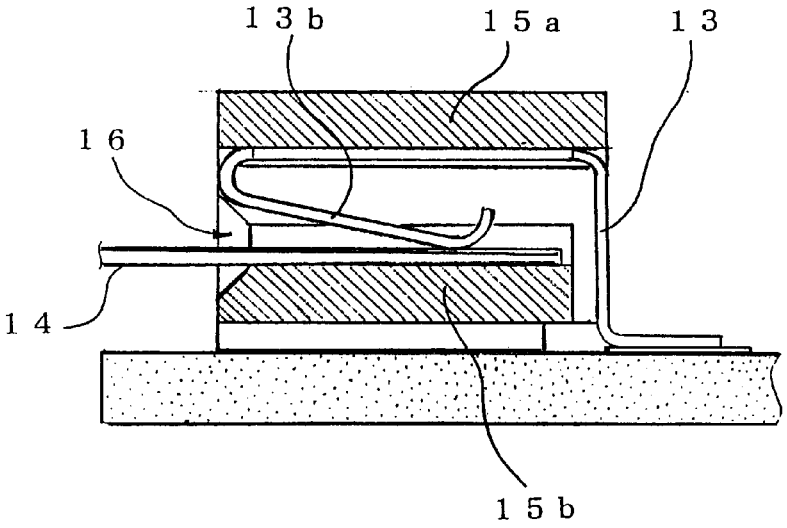

FIGURE 12 - PRIOR ART
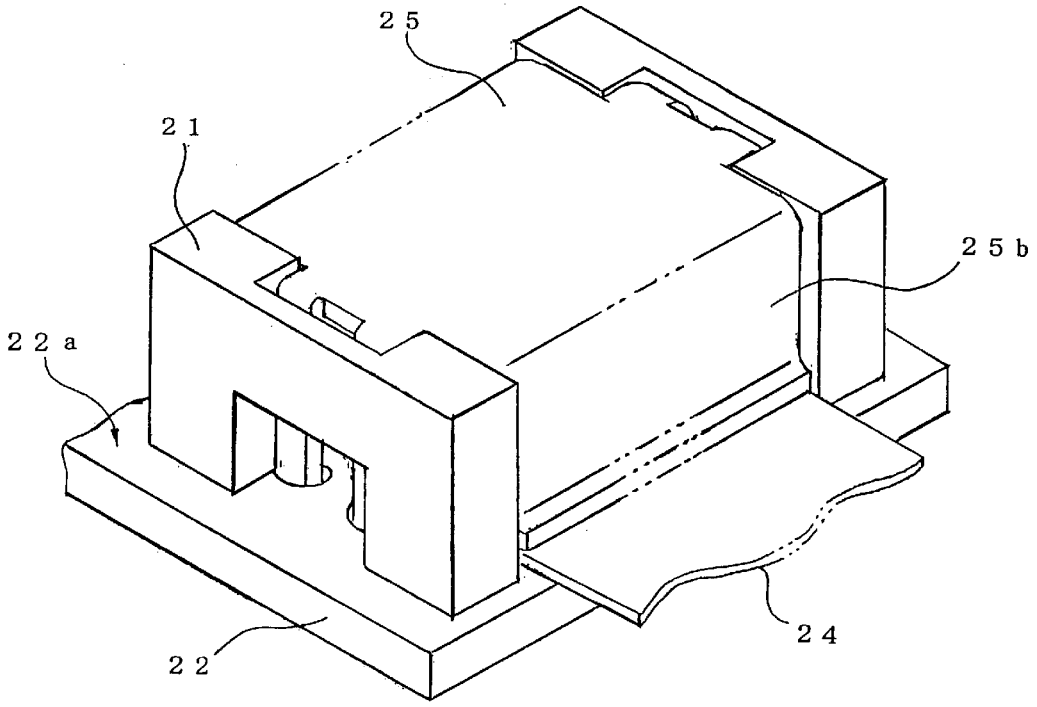
FIGURE 13 - PRIOR ART
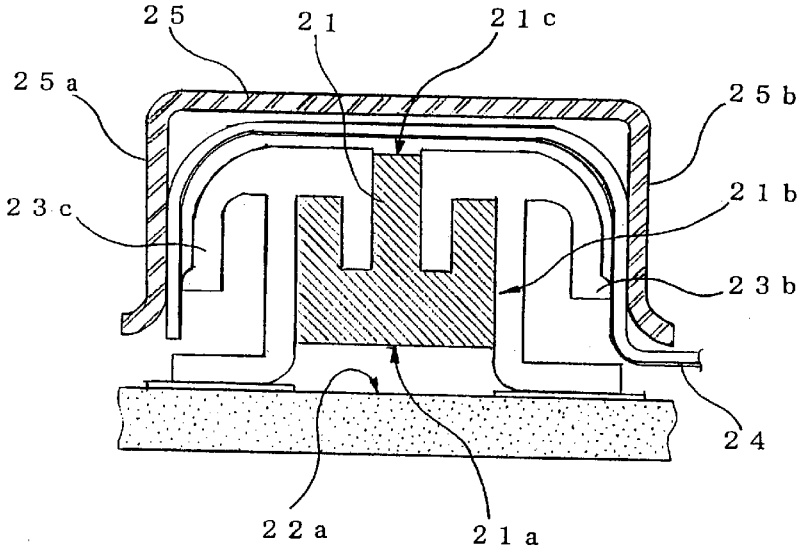

CONNECTOR FOR FLEXIBLE CONDUCTIVE LINE COMPONENTS

FIELD OF THE INVENTION

The present invention relates to a connection device for flexible conductive line components. More specifically, it relates to a connection device which affords electrical connection between a printed circuit board and a flexible conductive line component such as a flexible printed circuit ("FPC') or a flexible flat cable ("FFC").

BACKGROUND OF THE INVENTION

Conventional connectors for connecting a printed circuit board with the conductors of a FPC or the like include connectors that incorporated fork contacts as depicted in FIGS. 8 and 9. This type of connector 1 is mounted on the surface 2*a* of a printed circuit board 2, and comprises a plurality of contacts 3, each provided with a connection terminal portion 3*a* which is connected through soldering to a wiring pattern 2*b* on the printed circuit board 2 and with resilient spring portions 3*b* and 3*c* which clamp the connection conductors 4*a* of the FPC through spring force; and an insulator element 5 which holds the row of contacts in place. When manufacturing the contacts 3, a punched form having the contact shape depicted in cross section in FIG. 9 is produced from a sheet material by stamping in order to reduce the amount of bending required. With this process, the cut edge of the punched form constitutes the contact portion 3*d* of the resilient spring portion 3*b* which comes into sliding contact with a connection conductor 4*a* of the FPC. In some cases, this may damage the surface of the connection conductor 4*a*, producing an unreliable connection. Further, material strength considerations make it difficult to thin the contact 3 retainer portions 5*a* and 5*b* of the insulator element 5; accordingly, the component is unsuitable to meet the current requirements for lower profiles, that is, a lower connector profile when mounted on a printed circuit board.

One more type of conventional connector includes a plate spring contact (termed a "reverse cantilever type") as depicted in FIGS. 10 and 11. This type of connector is widely employed owing to its cost advantages. The disposition of elements in this connector 11 for connecting a FPC 14 to a printed circuit board 12 is analogous to that in the fork contact type depicted in FIGS. 8 and 9. While the reverse cantilever contact 13 reduces the problem of damage to the connection conductors 4*a* associated with the fork contact 3, and is easily assembled within the insulator element 5, it has problems of its own as when the number of contacts is increased to meet current requirement for multiway connections, it unavoidably causes increases in the sum of the forces applied to the FPC 14 by the resilient spring elements 13*b*. Such force may cause undesirable widening of the opening 16 provided to the insulator element 15 for insertion of the FPC 14, which may result in unreliable connection. It would be possible to prevent this by increasing the thickness of thin portions 15*a* and 15*b* of the insulator element 15, but this would render the component unsuitable as a connector to meet the lower profiles current requirements.

One additional type of conventional connector is the detachable cover type depicted in FIGS. 12 and 13, which is provided with a metal cover having a squared-off U-shaped transverse cross section. The connector body. 21 has a connection face 21*a* for effecting connection with the surface 22*a* of the printed circuit board 22, and outer contacts 23*b*, located at the side faces 21*b* adjacent to the connection face, for effecting connection with the FPC 24. A metal cover 25, which fits from the direction of the face 21*c* opposite the connection face 21*a* of the connector body 21, is provided with opposing side pieces 25*a* and 25*b* that clamp the connector body 21 and the FPC 24 together through spring force. With this structure, the reinforcing effect provided by the squared-off U-shaped cross section of the metal cover 25 reduces bending of the connector body 21 in the lengthwise direction. However, in order to accommodate FPC of various thicknesses, specifically, to provide consistent forcible contact as well as a clearly dissemble sensation associated with attachment and detachment of the cover regardless of the thickness of the board, it is necessary to ensure that the resilient spring pieces 23*c* and the metal cover side pieces 25*a* each have sufficient length. Accordingly, this structure is also unsuitable to meet the current need for low profiles.

It is therefore an object of the present invention to provide, in a device for connecting a flexible conductive line component to a printed circuit board, a connector for flexible conductive line components which overcomes the disadvantages of the aforementioned prior art connectors, and which affords reliable connections in a compact device.

SUMMARY OF THE INVENTION

The present invention provides a connector for flexible conductive line components which is used for effecting electrical connection between a flexible conductive line component provided at an edge of the connector with connection conductors and a printed circuit board provided with wiring patterns. The connector according to the invention comprises a metal plate having a substantially U-shaped transverse cross section mounted thereof such that at least one sidepiece of two opposing sidepieces is disposed essentially parallel to the printed circuit board; and a connector frame comprising a plurality of individual contact elements, each comprising a linking portion connecting to a resilient spring portion which provides contact with a connection conductor on the flexible conductive line component with a connection terminal portion for effecting connection with a wiring pattern on the printed circuit board. By this arrangement, the connection terminal portion and the resilient spring portion are disposed essentially parallel to the surface of the printed circuit board. The contact elements are being disposed in a row to link with an insulator element at the linking portions of the contact elements such that the resilient spring portions of the connector frame are accommodated within a space defined by the two opposing sidepieces of the metal plate to ensure that when the edge of the flexible conductive line component is inserted between the resilient spring portions and the metal plate, the connection conductors thereof are pushed into contact with the resilient spring portions.

The foregoing objects and specific construction of the present invention will become apparent and understandable from the following detailed description thereof, when read in conjunction with the accompanying drawings.

BRIEF DESCRIPTION OF THE DRAWINGS

FIG. 8 is a front view depicting the FPC connector of a conventional example mounted on a printed circuit board;

FIG. 9 shows a transverse section depicting the FPC connector of FIG. 8 with an FPC inserted;

FIG. 10 is a front view depicting the FPC connector of one more conventional example mounted on a printed circuit board;

FIG. 11 shows a transverse section depicting the FPC connector of FIG. 10 with an FPC inserted;

FIG. 12 is a perspective view depicting the FPC connector of another conventional example mounted on a printed circuit board; and FIG. 13 is a transverse section of FIG. 12.

DETAILED DESCRIPTION OF THE PREFERRED EMBODIMENTS

Figure 1:
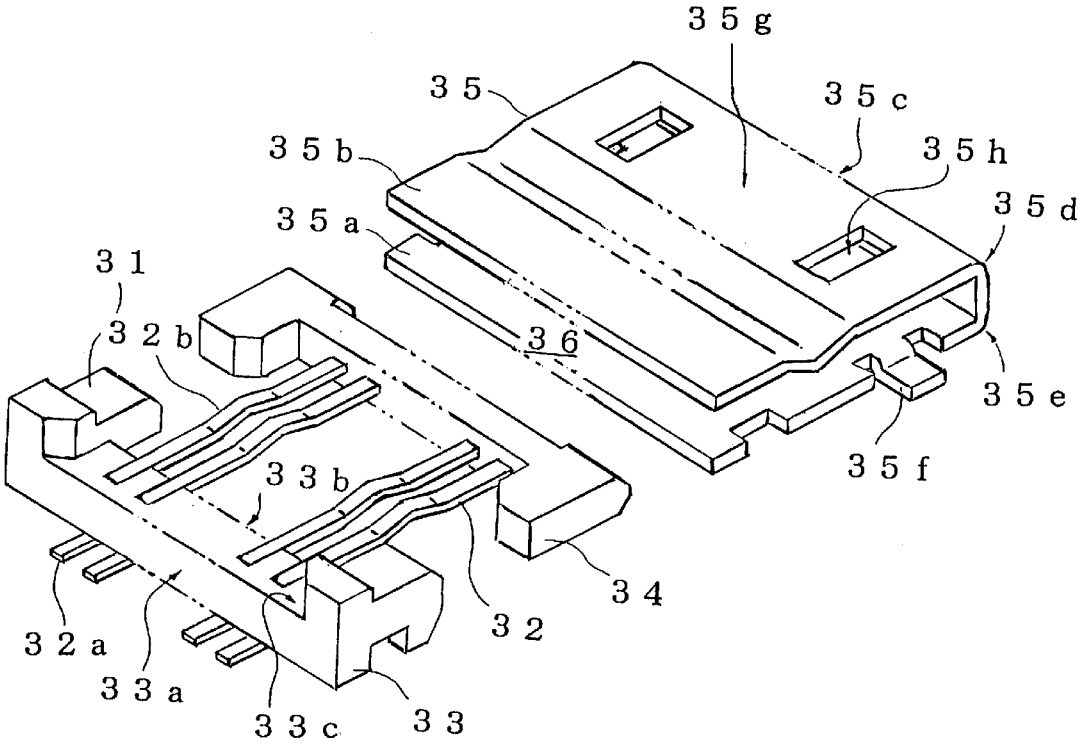
FIG. 1 is an exploded perspective view illustrating an embodiment of the connector for flexible conductive line components according to the present invention.
Figure 2:
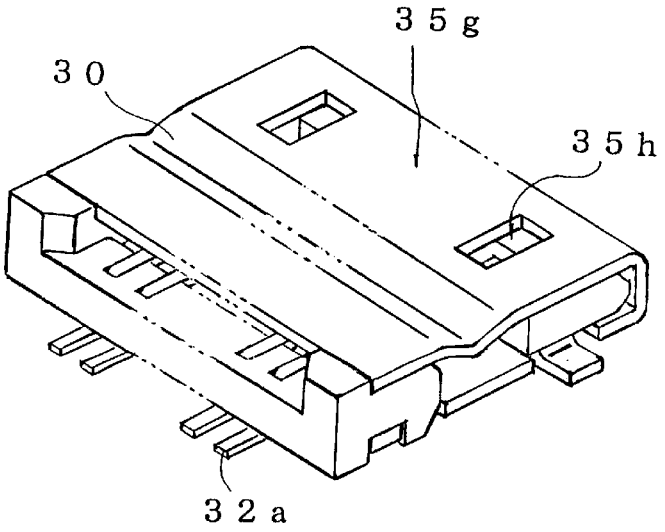
FIG. 2 shows a perspective view of the assembled connector for flexible conductive line components according to FIG. 1.
Figure 3:
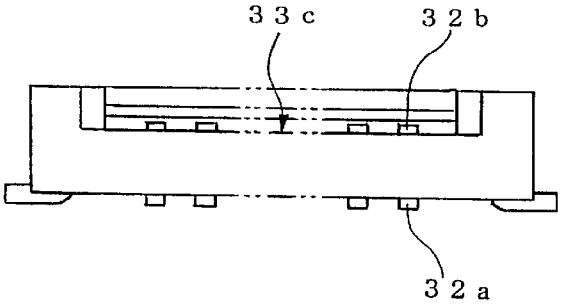
FIG. 3 is a front view of the connector for flexible conductive line components of FIG. 2.
Figure 4:
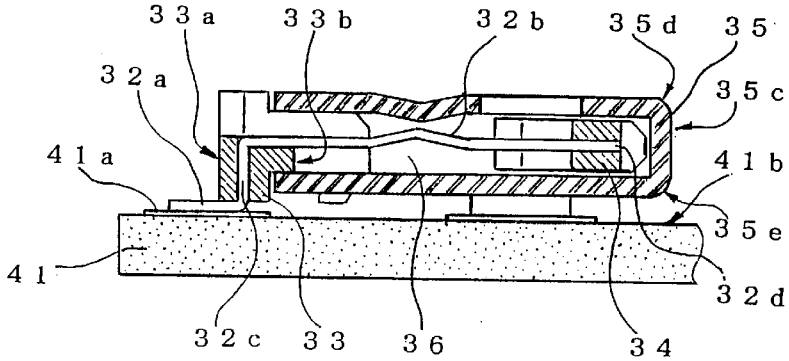
FIG. 4 shows a transverse section depicting the connector for flexible conductive line components of FIG. 2 mounted on a printed circuit board.
Figure 5:
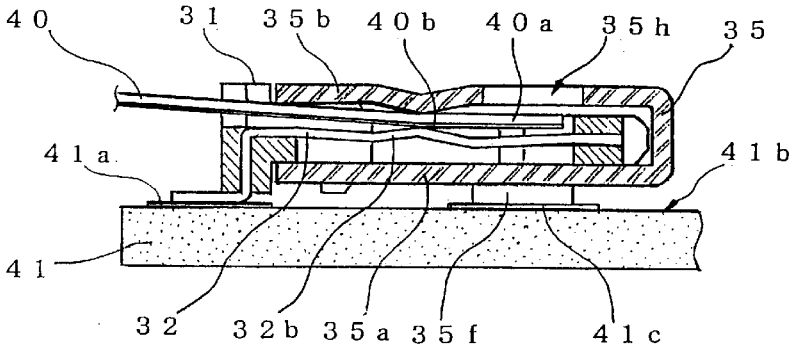
FIG. 5 shows a transverse section depicting an FPC inserted into the connector for flexible conductive line components of FIG. 2 mounted on a printed circuit board.
Figure 6:
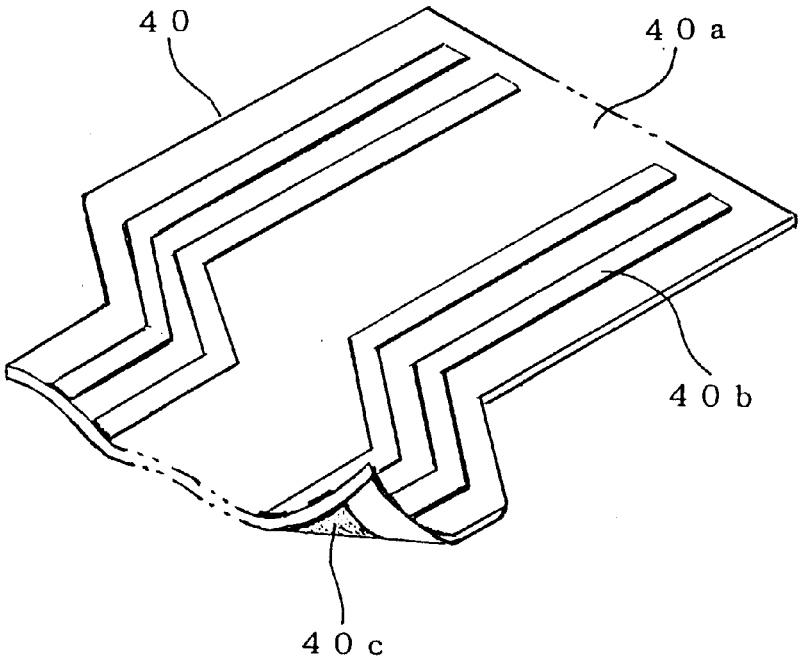
FIG. 6 is a perspective view depicting the edge of an FPC as an example of a flexible conductive line component.
Figure 7:
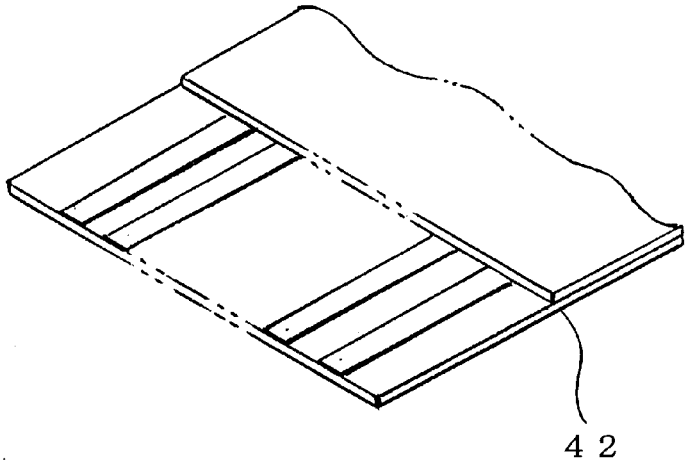
FIG. 7 shows a perspective view depicting the edge of an FFC as an example of a flexible conductive line component.

The present invention will be described below through the embodiments depicted in the drawings. More specifically, FIG. 1 is an exploded perspective view illustrating an embodiment of the connector for flexible conductive line components according to the present invention; FIG. 2 is a perspective view of the assembled connector according to FIG. 1; FIG. 3 is a front view of the connector for flexible conductive line components of FIG. 2; FIG. 4 shows a transverse section depicting the connector of FIG. 2 being mounted on a printed circuit board; FIG. 5 is a transverse section depicting an FPC inserted into the connector of FIG. 2 which is mounted on a printed circuit board; FIG. 6 is a perspective view depicting a surface an FPC as an example of a flexible conductive line component; and FIG. 7 is a perspective view depicting a surface of an FFC as an example of a flexible conductive line component.

Referring now jointly to FIGS. 1–5, the connector for connecting a flexible conductive line components 30 according to the present invention comprises a connector frame 31 which consists of a plurality of individual contacts 32 held arrayed in a row by a first insulator element 33, and a metal plate 35 having a substantially U-shaped transverse cross section with a first sidepiece 35*a* and a second sidepiece 35*b* disposed opposite each other.

Each of the individual contacts 32 comprises a resilient spring portion 32*b* for contacting a connection conductor 40*b* on a surface 40*a* of a FPC 40, and a connection terminal portion 32*a* for effecting connection with a wiring pattern 41*a* on a printed circuit board 41 through soldering or other means. The connection terminal portion 32*a* is connected to a linking portion 32*c*, where the first insulator element 33 is disposed, so as to project from opposite sides 33*a* and 33*b* of the first insulator element 33. The lengthwise extension of the resilient spring portions 32*b* and the lengthwise extension of distal ends of the connection terminal portions 32*a* are essentially parallel to a surface 41*b* of the printed circuit board 41, and by means of the first insulator element 33, the contacts 32 are held arrayed in a row at intervals which match the spacing of the connection conductors 40*b* on the FPC 40; the insulator element 33 is provided with a recessed receptacle portion 33*c* which serves as the open receptacle portion for insertion of the FPC 40 and which positions the connector frame 31 and the surface 40*a* with respect to each other in the transverse direction.

The metal plate 35 has a space 36, defined by the first sidepiece 35*a*, the second sidepiece 35*b*, and a connecting piece 35*c*, which partially accommodate the connector frame 30. The first sidepiece 35*a*, the second sidepiece 35*b*, and the connecting piece 35*c* are connected by two comer portions 35*d* and 35*e* which form essentially right angles, endowing the resilient metal sheet of which the metal plate 35 is formed with a substantially U-shaped cross section which, in terms of material strength, provides a reinforcing structure. One edge of the first sidepiece 35*a* is provided with a reinforcing tab 35*f* which is held in place by soldering to a mounting pad 41*c* on the printed circuit board 41. Certain areas of the gap between the opposing faces of the second sidepiece 35*b* and the resilient spring portions 32*b* are designed to be narrower than the thickness of surface 40*a* when the metal plate 35 and the connector frame 31 are assembled and mounted, so that when the edge 40*a* of the FPC 40 is inserted through the recessed receptacle portion 33*c* to reach the resilient spring portions 32*b*, the connection conductors 40*b* are pushed into contact with the resilient spring portions 32*b*. The spatial relationships among these portions afford electrical connections among the connection conductors 40*b* of the FPC 40 and the wiring patterns 41*a* of the printed circuit board 41 through the individual contacts 32. A flat area 35*g* is provided on the top surface of the metal plate, which is utilized as a holding face during automated mounting of the flexible conductive line connector 30.

The connector frame 31 is also provided with a second insulator element 34, separate from the first insulator element 33, for holding in a row array distal end portions 32*d* of the plurality of individual contacts 32. The second insulator element 34 electrically insulates the distal end portions 32*d* from the metal plate 35 and prevents them from rattling within the space 36.

The metal plate 35 is provided with at least one hole 35*h*, located in the second sidepiece 35*b*, which allows for a visual determination as to whether surface 40*a* of the FPC 40 has been inserted to a sufficient extent to pass through the recessed receptacle portion 33*c* and to slide over the resilient spring portions 32*b* so as to abut the second insulator element 34. The hole 35*h* also allows one to check for any change in position of surface 40*a* that might occur as the result of application of external force to the FPC 40 in the direction opposite the direction of insertion. The shape, size, and location of the hole 35*h* can be changed or modified as appropriate for stable connection; in general, the hole is functional when placed in a location such that portions of the second insulator element 34 and the resilient spring portions 32*b* are visible.

During manufacture, it is possible to provide the FPC 40 with a separate exposed conductor layer 40*c* located on the back side from the face on which the connection conductors 40*b* are located, that is, the side which comes into contact with the second sidepiece 35*b* of the metal plate 35. Where the surface of the second sidepiece 35*b* of the metal plate 35 is conductive, the metal plate 35 will afford electrical connection between the exposed conductor layer 40*c* and the mounting pad 41*c* located on the printed circuit board 41 when surface 40*a* is inserted as far as the resilient spring portions 32*b*. In such a connection system, if the mounting pad 41*c* is wired to the ground circuit on the printed circuit board 41, the metal plate 35 and the exposed conductor layer 40*c* will also be connected to the ground circuit; where the individual contacts 32 and the connection conductors 40*b* are used as signal circuits to produce useful electrical characteristics.

The printed circuit board 41 described in the foregoing embodiment of the present invention is a rigid circuit board lacking flexibility. FPCs (flexible printed circuits) are commonly considered to be one kind of printed circuit board, and the connector for flexible conductive line components according to the invention is essentially adapted to mounting on FPCs as well. Accordingly, the connector provided by the present invention may be implemented as a junction connector for electrically connecting an FPC, FFC (flexible flat cable), or other flexible conductive line component to an FPC. The basic structure of the connector can also be adapted for use as a zero insertion force connector by inserting a spacer into the space 36 between the two sidepieces 35*a* and 35*b* in order to expand it. The spacer can then be removed once the FPC 40 has been inserted.

Although the preferred embodiment of the invention has been disclosed for illustrative purposes, those skilled in the art will appreciate that various modifications, additions and substitutions are possible, without departing from the scope and spirit of the invention, as disclosed in the accompanying claims.

I claim:

1. A connector for effecting electrical connection between connection conductors disposed on a surface of a flexible conductive line component and wiring patterns of a printed circuit board, comprising:

a metal plate having a substantially U-shaped transverse cross section with a first sidepiece and a second sidepiece disposed opposite each other wherein said substantially U-shaped transverse cross section is mounted on said metal plate such that at least one of the first sidepiece and the second sidepiece is disposed essentially parallel to said printed circuit board;

a connector frame comprising a plurality of individual contact elements and a pair of insulator elements, each of said contact elements further comprising a linking portion, a resilient spring portion and a connection terminal portion wherein said linking portion connects to said resilient spring portion for contacting one of said connection conductors on said flexible conductive line component while said connection terminal portion provides connection with one of said wiring patterns on said printed circuit board in such a way that said resilient spring portion and said connection terminal portion are disposed essentially parallel to a surface of said printed circuit board; said plurality of individual contact elements are being disposed in a row through said linking portions held by said pair of insulator elements to provide electrical insulation of said plurality of individual contact elements from said metal plate; and wherein said resilient spring portion of said contact elements are accommodated within a space defined by the first sidepiece and the second sidepiece of the metal plate in such a way that when the surface of said flexible conductive line component is inserted between said resilient spring portion and the metal plate, said connection conductors thereof are pushed into contact with the resilient spring portion.

2. The connector of claim 1 wherein said metal plate is further provided with a hole which, when the surface of said flexible conductive line component has been inserted into the space defined by the first sidepiece and the second sidepiece, allows said inserted surface to be viewed from the outside.

3. The connector of claim 1 wherein said surface of said flexible conductive line further comprises an exposed conductor layer, separate from the connection conductors, to provide an electrical connection between said exposed conductor layer and said metal plate when said surface has been inserted between said resilient spring portion and said metal plate.

* * * * *